US007811013B2

(12) United States Patent
Perez et al.

(10) Patent No.: US 7,811,013 B2
(45) Date of Patent: Oct. 12, 2010

(54) MEDIA GUIDE

(75) Inventors: Jimmy Perez, Corvallis, OR (US); Bradley Allison Bower, Junction City, OR (US); Kevin E. Swier, Albany, OR (US); John W. Lee, Sweet Home, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 555 days.

(21) Appl. No.: 11/830,805

(22) Filed: Jul. 30, 2007

(65) Prior Publication Data

US 2009/0035043 A1 Feb. 5, 2009

(51) Int. Cl.
*B41J 3/28* (2006.01)
*B41J 3/36* (2006.01)

(52) U.S. Cl. ..... 400/23; 400/29; 400/88; 347/109

(58) Field of Classification Search ..... 400/23, 400/29, 88; 347/109
See application file for complete search history.

(56) References Cited

U.S. PATENT DOCUMENTS

| | | | | |
|---|---|---|---|---|
| 5,065,169 | A | 11/1991 | Vincent et al. | |
| 5,184,907 | A | 2/1993 | Hamada et al. | |
| 5,534,902 | A | 7/1996 | Hoesly | |
| 6,491,386 | B2 | 12/2002 | Hierro et al. | |
| 2004/0109034 | A1 * | 6/2004 | Brouhon | 346/143 |
| 2008/0170900 | A1 * | 7/2008 | James et al. | 400/88 |

FOREIGN PATENT DOCUMENTS

| | | | |
|---|---|---|---|
| JP | 62090267 | A * | 4/1987 |
| JP | 63274554 | A * | 11/1988 |
| JP | 2001146041 | A * | 5/2001 |
| JP | 2002307756 | A * | 10/2002 |

* cited by examiner

*Primary Examiner*—Daniel J Colilla

(57) ABSTRACT

Various embodiments and methods are disclosed relating to one or more media guides configured to guide a surface being printed upon relative to a manually moved print device.

18 Claims, 8 Drawing Sheets

MEDIA GUIDE

CROSS-REFERENCE TO RELATED PATENT APPLICATIONS

The present application is also related to co-pending U.S. patent application Ser. No. 11/830,838 filed on the same day by Erica S. Strandberg and Jeffrey John Buresh and entitled HAND MOUNT and co-pending U.S. patent application Ser. No. 11/830,765, filed on the same day by Anthony D. Studer et al. and entitled PRINTHEAD PRECONDITIONING TRIGGER, the full disclosures of which is hereby incorporated by reference.

BACKGROUND

Printing is sometimes performed on soft or compressible surfaces. Such printing is often smeared and lacks print quality.

DETAILED DESCRIPTION OF THE EXAMPLE EMBODIMENTS

Figure 1:
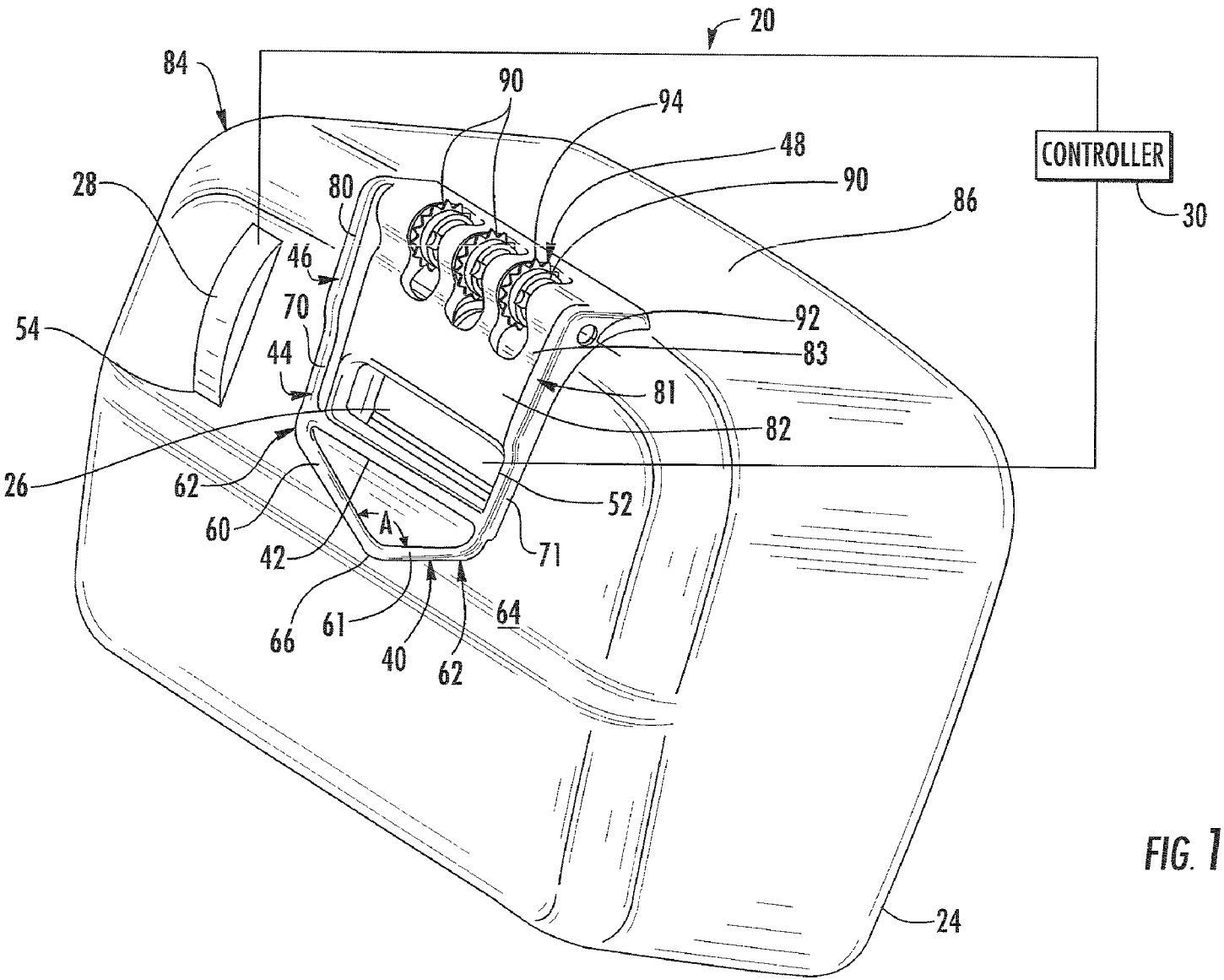
FIG. 1 is a perspective view of a portion of a print unit with portions schematically illustrated according to an example embodiment.
Figure 2:
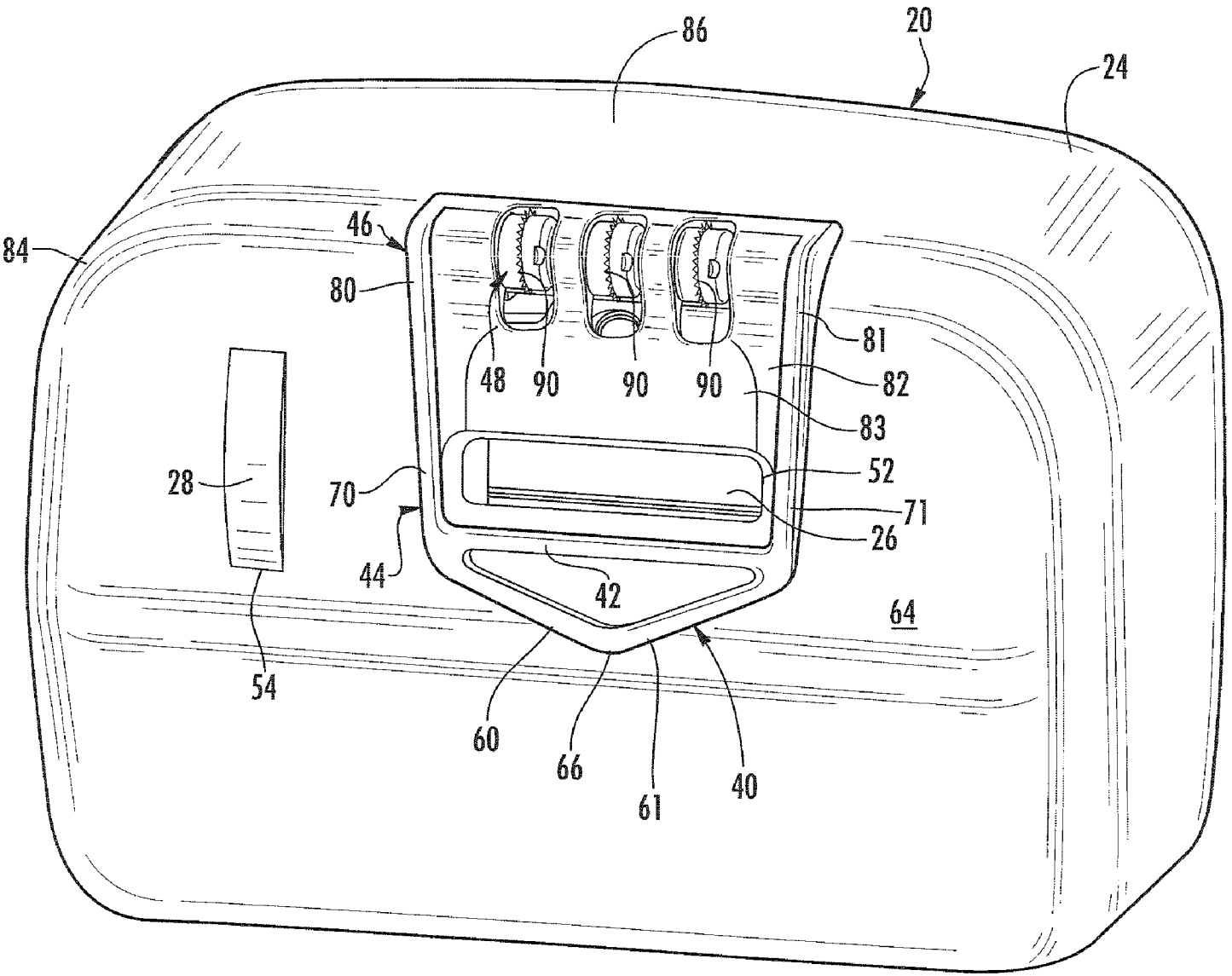
FIG. 2 is another perspective view of a portion of the print unit of FIG. 1 according to an example embodiment.

FIGS. 1 and 2 illustrate a portion of a printing unit 20 according to an example embodiment. Printing unit 20 is configured to print upon soft, flexible or compressible surfaces. In the example illustrated how printing unit 20 comprises a handheld unit configured to be manually grasped and carried or moved across a surface during printing upon the surface. As will be described hereafter, printing unit 20 includes one or more media guides which are configured to control positioning of the surface during and after printing to reduce the likelihood of smearing and to enhance print quality.

As shown by FIG. 1, printing unit 20 includes housing 24, print device 26, encoder wheel 28, controller 30 and media guides 40, 42, 44, 46 and 48. Housing 24 comprises one or more structures which, together, enclose or at least partially surround and support remaining components of printing unit 20. Housing 24 provides a body configured to be manually grasped or partially wrapped about by an individual's hand and to be positioned or moved in three axes relative to a surface being printed upon. Housing 24 supports components of printing unit 20 such a printing unit 20 extends adjacent to a single face or side of a surface being printed upon during printing without extending around a medium or supporting the medium from an underside or backside of the medium.

As shown by FIG. 1, housing 24 at least partially encloses and receives print device 26 and includes an opening 52 through which print device 26 prints upon a surface of a medium. Housing 24 further at least partially encloses encoder wheel 28 and includes an opening 54 through which encoder wheel 28 projects for engagement with the surface of the medium. In other embodiments where print device 26 or encoder wheel 28 have different configurations, such openings 52 and 54 may also have different configurations. For example, although opening 52 is illustrated as being located in front of print device 26, in other embodiments, opening 52 may alternatively extend around a side perimeter of print device 26. In some embodiments where encoder wheel 28 is omitted, opening 54 may also be omitted.

Print device 26 comprises a component configured to print or deposit printing material, such as ink, upon a surface through opening 52. According to one embodiment, print device 26 comprises a drop-on-demand inkjet print head having nozzles through which ink is ejected. Examples of such inkjet print heads include thermoresistive inkjet print heads and piezo resistive inkjet print heads. In other embodiments, print device 26 may comprise other device configured to deposit, print or mark a surface of the medium.

Encoder wheel 28 comprises a wheel configured to be rolled or rotated along a surface while in contact with the surface so as to sense or detect relative movement up unit 20 and the surface. Encoder wheel 28 is operably coupled to an encoder system by which signals are generated and transmitted to controller 30 which uses such signals to control printing by print device 26. In other embodiments, printing unit 20 may additionally include a separate idling wheel (not shown) on an opposite side of print device 26 as encoder wheel 28 to maintain a level orientation a print device 26 opposite the surface being printed upon. In yet other embodiments, encoder wheel 28 may be omitted.

Controller 30 (schematically shown) comprises one or more processing units configured to generate control signals directing printing by print device 26. In the particular example illustrated, controller 30 receives signals via encoder wheel 28 during manual movement of print unit 20 across the surface being printed upon. Based upon the relative movement, controller 30 generates control signals controlling what particular nozzles of print device 26 are fired and the rate at which they are fired to eject ink or other printing material through opening 52 and onto the surface opposite to print device 26.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 30 may be embodied as part of one or more application-specific integrated circuits (ASICs). Unless otherwise specifically noted, the controller is not limited to any specific combination of hardware circuitry and software, nor to any particular source for the instructions executed by the processing unit.

Media guides 40, 42, 44, 46 and 48 contact, engage and direct or maintain positioning of the surface of the medium prior to printing, during printing and after printing. Media guides 40, 42, 44, 46 and 48 assist (1) in flattening a soft, flexible or compressible surface, which may be wavy, undulating or otherwise not flat, prior to and during printing upon the surface to enhance print quality such as the sharpness of the text, image or other printed content being formed and (2) in maintaining the printed upon surface in the flat state and out of contact with print unit 20 to reduce the likelihood of smearing of the printed content. Although each of media guides 40, 42, 44, 46 and 48 may be used independently of one another in other embodiments, in the particular example illustrated, such media guides synergistically cooperate with one another to enhance print quality and reduce smearing.

Media guide 40 comprises a pair of elongate projections, bars or ribs 60, 61 which diverge or spread apart from each other as they approach print device 26. Ribs 60, 61 extend at an angle A with respect to one another. In one embodiment, angle A is between about 125 degrees and about 135 degrees and nominally about 130 degrees. Ribs 60, 61 diverge and spread apart from one another until their ends 62 are laterally beyond outer lateral sides of the nozzles of print device 26. Ribs 60, 61 extend from a face 64 of housing 24 on an upstream side of print device 26. In other words, ribs 60, 61 are configured to contact a surface to be printed upon prior to print device 26 being positioned opposite the surface and prior to printing upon the surface given a direction in which unit 20 is to be moved across a surface during printing. In the example illustrated, ribs 60, 61 are interleaved formed as part of single unitary body with housing 24, reducing fabrication and assembly costs. In other embodiments, ribs 60, 61 may be mounted to housing 24 by welding, adhesives, fasteners and the like.

Ribs 60, 61 serve to contact, spread and flatten a compressible and potentially wavy or non-flat surface prior to the print device 26 being located opposite to the surface. Because ribs 60, 61 are continuous, ribs 60, 61 better engage and spread the contacted surface. Because ribs 60, 61 diverge to locations beyond outer lateral sides of print device 26, substantially all the surface subsequently positioned opposite to print device 26 is spread and flattened.

Although ribs 60, 61 are illustrated as converging to a point 66, in other embodiments, ribs 60, 61 may alternatively be disconnected. Although ribs 60, 61 are illustrated as connected to media guide 42, and other embodiments, ribs 60, 61 may be spaced from media guide 42. Although ribs 60, 61 are illustrated as each being generally linear bars, in other embodiments, ribs 60, 61 may be non-linear or have other configurations. Although ribs 60, 61 are illustrated as being continuous, ribs 60, 61 may alternatively be comprised of a plurality of spaced segments or bumps.

Media guide 42 comprises an elongate projection, bar or rib extending laterally across print device 26 on an upstream side of print device 26 between media guide 40 and print device 26. The rib of media guide 42 extends substantially perpendicular to a direction in which unit 20 is moved across a surface during printing. While ribs 60, 61 of media guide 40 spread or flatten the surface (to place a surface in tension) in a lateral direction, the rib of media guide 42 flattens the surface in a longitudinal direction, parallel to a direction in which unit 20 is moved across the surface being printed upon. As a result, the surface being printed upon is spread or flattened in both longitudinal and lateral directions prior to being printed upon.

Because the rib of media guide 42 continuously extends laterally across substantially the entirety of print device 26, a larger percentage, if not all, of the surface being printed upon is spread in the longitudinal direction. However, in other embodiments, the rib of media guide 42 may alternatively be composed of multiple spaced segments or bumps and may have a length shorter than the width of print device 26. In yet other embodiments, media guide 42 may be omitted.

Media guide 44 comprises a pair of opposing projections, bars or ribs 70, 71 extending on opposite lateral or transverse sides of print device 26 directly across from print device 26 such a print device 26 is sandwich therebetween. Ribs 70, 71 extend from ends 62 of ribs 60, 61 to assist in maintaining the surface in a spread or flat state as it is being printed upon by print device 26. Although ribs 70, 71 are illustrated as continuously extending longitudinally across from a front end to a rear end of print device 26, in other embodiments, ribs 70, 71 may alternatively be formed from multiple spaced segments or bumps and may have other longitudinal extents along the sides of print device 26. In yet other embodiments, ribs 70, 71 may be omitted.

Media guide 46 comprises a pair of opposing projections, bars or ribs 80, 81 extending on opposite lateral or transverse sides of print device 26 longitudinally downstream of print device 26. Ribs 80, 81 project from face of 64 of housing 24 by a larger distance as compared to ribs 70, 71. As a result, ribs 80, 81 space the printed upon surface further away from face of 64. Ribs 80, 81 form an intermediate cavity or recess 82 adjacent to and downstream of print device 26 and downstream of opening 52. In the example illustrated, the depths of the recess is further enlarged by a depression 83 formed in the face 64 of housing 24. Consequently, the freshly printed upon surface is less likely to contact unit 20. Given additional time for the printed upon surface to dry, the likelihood of smearing is reduced.

In the example illustrated, ribs 80, 81 each have a height above surfaces of housing 24 adjacent to opening 52 of at least 1.5 mm and nominally about 1.6 mm. Ribs 80, 81 have a height extending beyond the height of ribs 70, 71 by at least about 0.4 mm and nominally about 0.5 mm. In other embodiments, ribs 80, 81 may have other dimensions. Although ribs 80, 81 are illustrated as continues extending from print device 26 to media guide 48 and to a corner 84 of print unit 20, in other embodiments, ribs 80, 81 may have other lengths and may alternatively be comprised of multiple distinct spaced segments or bumps. In still other embodiments, ribs 80, 81 may be omitted.

Media guide 48 comprises one or more structures configured to contact the printed upon surface directly on top of the printing material deposited on the surface so as to track the surface and further maintain the spread or flat state of the printed upon surface. Media guide 48 is located at or along corner 84 between face 64 of housing 24 (along which printing occurs) and a top face 86 of housing 24. In the example illustrated, media guide 48 comprises a set of rotationally supported wheels 90 which idle (are not driven under power).

As shown by FIG. 1, wheels 90 rotate about axis 92 and are axially spaced from one another. Each wheel 90 includes a multitude of circumferentially spaced projections 94 configured to contact the printed upon surface. Projections 94 facilitate rugged gripping of the surface to track relative movement of the surface and unit 20 with a reduced footprint. As a result, the extent to which media guide 48 leaves tracks or marks on the printed upon media is reduced. In one embodiment, each of wheels 90 may comprise a star wheel, a pizza cutter shaped wheel, wheels with small feet or other low surface area media contacting circumferential portions.

In the particular example illustrated, media guide 48 includes a three axially spaced wheels 90. Each of wheels 90 has a diameter (between opposing tips or points) of between about 5.2 mm and about 5.4 mm, and nominally about 5.3 mm. In other embodiments, media guide 48 may include a greater or fewer of such wheels 90 longitudinally downstream from print device 26. Wheels 90 may also have other dimensions. In other embodiments, wheels 90 of media guide 48 may be provided at other locations other than corner 84 or may be omitted.

Figure 3:
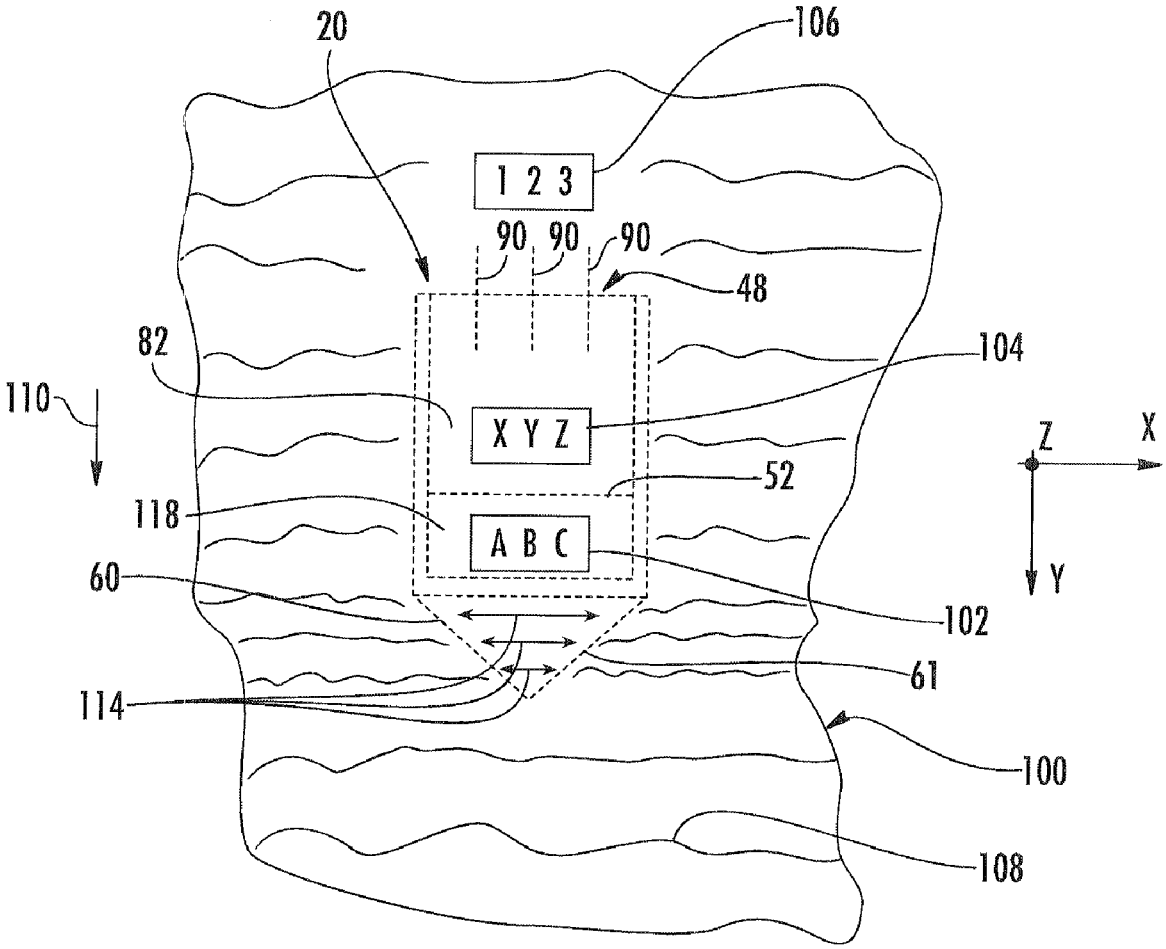
FIG. 3 is a top plan view illustrating the print unit of FIG. 1 printing upon a surface according to an example embodiment.

Overall, media guides 40, 42, 44, 46 and 48 flatten the media during printing and prevent wet ink or other printing material from coming in contact with unit 20. FIG. 3 illustrates media guides 40, 42, 44, 46 and 48 (shown in broken lines) during printing as unit 20 and an opposite soft, compressible or flexible surface 100 and unit 20 are moved relative to one another. In particular, FIG. 3 illustrates unit 20 being manually moved or slid across surface 100. As shown in FIG. 3, because surface 100 is soft, compressible or flexible, surface 100 includes surface irregularities, such as undulations or waves 108 which may extend in both the longitudinal y-axis in the transverse x-axis. FIG. 3 illustrates the printing of markings 102, 104 and 106 upon surface 100. Because of media guides 40, 42, 44 and 46, markings 102, 104 and 106 have improved print quality and a reduced extent of smearing.

As shown by FIG. 3, print unit 20 is moved along the z-axis into proximity with surface 100 until ribs 60, 61, 70, 71 and 80, 81 are brought into contact with surface 100. Unit 20 is manually moved across surface 100 in the direction indicated by arrow 110 longitudinally along the y-axis. As ribs 60, 61 are moved in a direction of arrow 110, ribs 60, 61 spread the undulations 108 of surface 100 outwardly in directions along the x-axis as indicated by arrows 114. As surface 100 passes beneath or across the rib of media guide 42, undulations in the y-axis direction are further flattened. In other words, surface 100 stretched in both the x-axis and y-axis directions and is placed in tension. Ribs 70, 71, extend on opposite sides of print device 26 (shown in FIG. 1) to maintain portion 118 of surface 100 in a flattened state during printing. As a result, portion 118 of surface 100 directly opposite print device 26 is substantially flat such that marking 102 is also printed on a flat surface, providing marking 102 with enhanced sharpness and print quality.

Once a marking has been printed through opening 52 and between ribs 70, 71, continued movement of print unit 20 results in ribs 80, 81 being moved on opposite side of the freshly printed marking. The elevated height of ribs 80, 81 (the contour of ribs 80, 81) lifts print unit 20 farther away from the freshly printed marking such that the freshly printed ink or other printing material is less likely to contact printing unit 20 and is less likely to smear. FIG. 3 illustrates a freshly printed marking 104 between ribs 80 and 81 and within recess 82 formed therebetween.

FIG. 3 further illustrates movement of unit 20 such that unit 20 is no longer overlying previously printed label or marking 106. During such a movement of print unit 20, wheels 90 of media guide 48 roll across the flattened portions of surface 100 between ribs 80, 81 and are intermittently contacting surface 100. Wheels 90 grip the flattened surface to maintain the flattened surface in tension and to inhibit reforming of the undulations 108 within recess 82. At the same time wheels 90 do not impose a large footprint upon surface 100. Wheels 90 also assist in tracking or guiding movement of print unit 20 across surface 100 in a more linear or straight fashion. In addition, wheels 90 further assist in elevating print unit 20 above the freshly printed marking 104 while it is within recess 82. As a result, the printed marking 106 is exited from any print unit 20 after having sufficient time to dry while in a flattened state, producing a marking on a soft or compressible surface as high print quality and little smearing.

Figure 4:
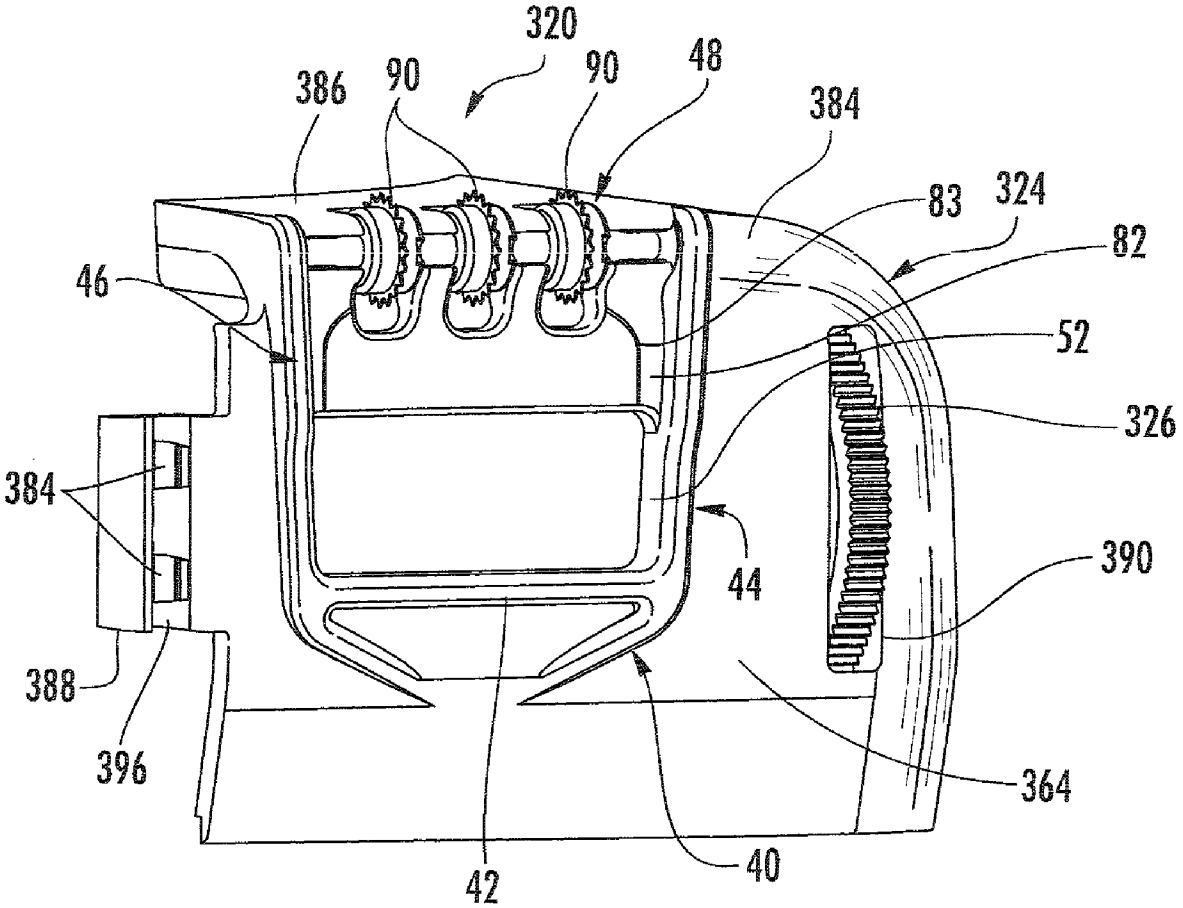
FIG. 4 is a perspective view of a media guide attachment according to an example embodiment.

FIG. 4 is a perspective view of media guide attachment 320. Media guide attachment 320 comprises an assembly of one or more structures including media guides that is configured to be movably mounted to a remainder of a print unit including a print device (such as print device 26 shown in FIG. 1 or print device 342 shown in FIG. 5). In the particular example illustrated, media guide attachment 320 mounts to a print unit such that attachment 320 functions as a door or cover which may be removed and separated from the remainder of the print unit for repair or replacement. In the example illustrated, removal of attachment 320 provides access to the print device, facilitating removal of the print device. For example, in one embodiment, the print device may comprise a drop-on-demand inkjet print head cartridge. Removal of attachment 320 enables a cartridge to be removed from the print unit for replacement or refilling with ink. In other embodiments, attachment 320 may be movably mounted to a remainder of a print unit such that attachment 320 may swivel or pivot about an axis between an open state, providing access to the print device, and a closed state for printing.

As shown by FIG. 4, media guide attachment 320 includes support 324, leveling wheel 326 and media guides 40, 42, 44, 46 and 48. Support 324 comprises one or more structures configured to support leveling wheel 326 and provide media guides 40-48. Support 324 is further configured to be releasably or movably mounted to a remainder of a print unit, such as print unit 20 or other printing units having a print device 26 (shown described with respect to FIG. 1). Support 324 generally includes a face 364 and a top 386 which form a corner 384. Face 364 and top 386 substantially form a front nose of the print unit to which media guide attachment 328 is mounted. Face 364 is configured to be positioned opposite to a surface to be printed upon during printing. Face 364 includes media guides 40-48, wherein media guide 48 is located at corner 384.

Support 324 further includes aperture 387 and attachment portion 388. Aperture 387 comprises an opening through support 324 and adjacent to face 364. Aperture 390 permits leveling wheel 326 to project through support 324 and into engagement with a service being printed upon. And embodiments where leveling wheel 326 is omitted, aperture 390 may be omitted.

Attachment portion 388 comprises this structure mechanism configured to releasably connect or mount a remainder of structure 324 to a print unit. In the example illustrated, attachment portion 388 comprises a snap lock mechanism. In particular, attachment portion 388 comprises a resiliently flexible hook 392 shown in FIG. 7 and protrusions 394 shown in FIG. 6. Hook 392 and protrusions 394 form an intermediate channel 396 configured to receive a pin or shaft 398 (shown in FIG. 6). During such insertion, hook 392 resiliently flexes away protrusions 394, wherein once pin or shaft 398 is fully inserted into channel 396, hook 392 resiliently returns to its original position spaced from protrusions 394 by distance less than a diameter of pin 398, capturing shaft 398 and securing attachment 320 (shown in FIG. 5) to unit 330. As will be described thereafter, attachment portion 388 further pivotably connects attachment 320 to unit 330 such that attachment 320 also serves as a pivoting door. In other embodiments, attachment portion 388 may have various other configurations facilitating releasable mounting of support 324 to a print unit.

Leveling wheel 326 comprises a wheel rotationally journaled or supported by support 324 so as to project through aperture 390. Wheel 326 is configured to project from aperture 390 by a distance substantially equal to the distance at which an encoder wheel (such as encoder wheel 28 shown in FIG. 1 or encoder wheel 361 shown in FIG. 5) projects beyond the printing device. Leveling wheel 326 assists in maintaining face 364 at a level orientation with respect to or parallel to the opposite print media surface. In other embodiments where leveling wheel 326 is provided by the remainder of the print unit and his rotationally supported by the remainder of the print unit, media guide attachment 320 may omit wheel 326 and merely include an aperture 390 for the wheel. In still other embodiments where encoder 361 is omitted, wheel 326 and aperture 390 may be omitted.

Media guides 40-48 are described above with respect to print unit 20 and FIG. 1. As shown in FIG. 4, in the example embodiment illustrated, each of media guides 40, 42, 44 and 46 are integrally formed as part of a single unitary body with support 324. Media guide 48 extends at corner 384 of media guide attachment 320. As with media guides 40-48 of print unit 20, media guides 40-48 of media guide attachment 320 flatten the media during printing and prevent wet ink or other printing material from coming in contact with media guide attachment 320 or the printing unit to which media guide attachment 320 is mounted.

Figure 5:
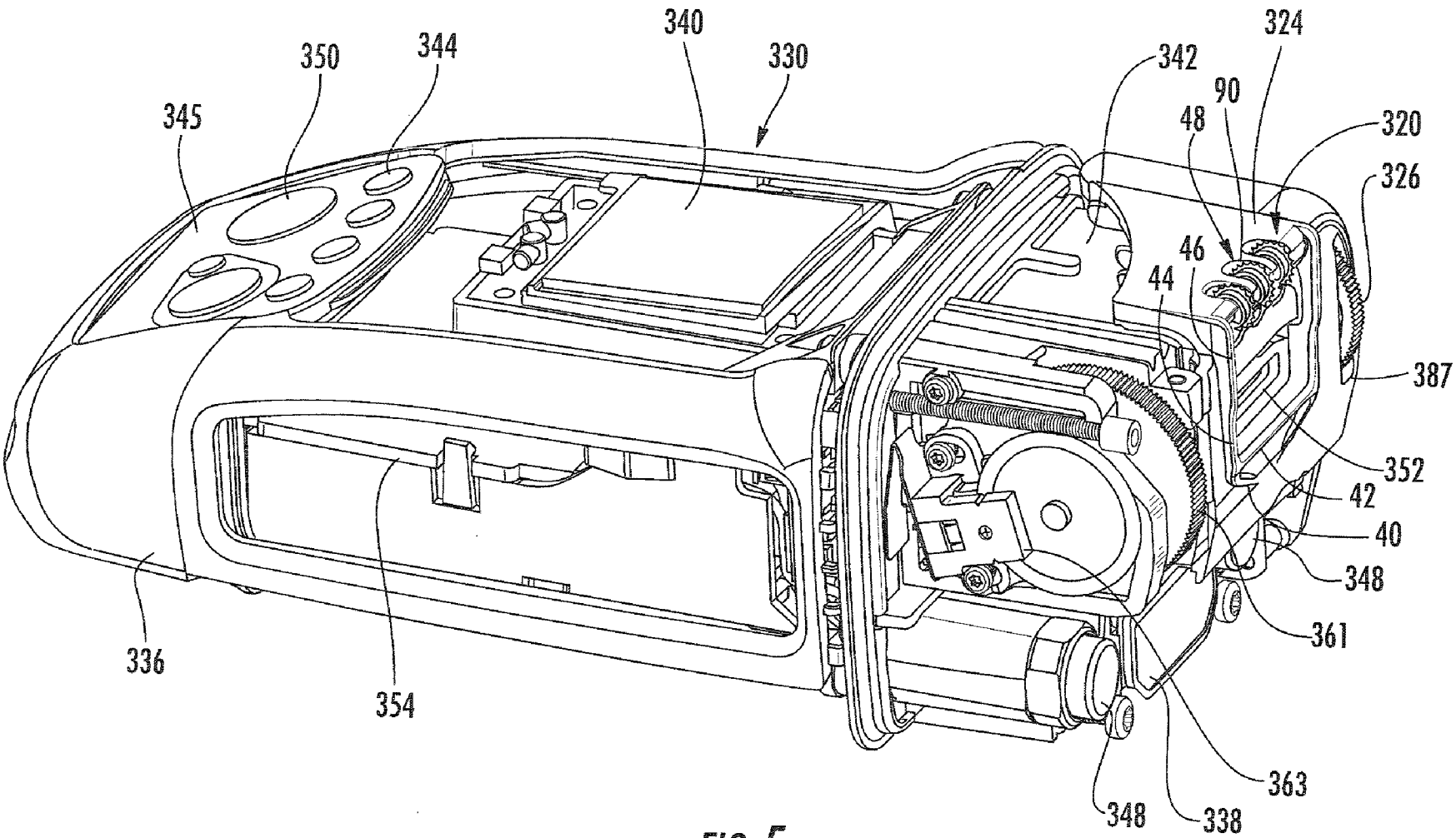
FIG. 5 is a fragmentary top perspective view of the media guide attachment of FIG. 4 mounted to another embodiment of the print unit of FIG. 1 according to an example embodiment.

FIG. 5 is a fragmentary perspective view illustrating media guide attachment 324 mounted to an example capture and print unit 330. Capture and print unit 330 is configured to capture or sends a data or image from a surface and to print data or image onto the same surface or a different surface based upon the captured or sends data. Capture and print unit 330 includes body 336, imager 338, communication interface 340, print device 342, indicator 344, user interface 345, print sensor 346, sensor 348, manual trigger 350 and controller 354.

Body 336 comprises a structure or case configured to support the remaining components of capture and print unit 330. Body 336 at least partially encloses or houses such components. In one embodiment, body 336 is configured such that capture and print unit 330 is a hand held unit. As shown in FIG. 4, body 336 is a block, cylinder or similar structure configured to be grasped by a person's hand with the person's fingers wrapped about body 336. In the particular embodiment illustrated, body 336 is formed from a thermally conductive material such as a metal, such as magnesium, to enhance cooling of internal componentry of capture and print unit 330. In other embodiments, body 336 may be formed from other materials such as plastic materials or combinations of plastics, metals or other materials.

Imager 338 is configured to sense, scan or capture an image upon a surface. In one embodiment, imager 338 comprises a scanner module comprising a two dimensional (2D) Imaging Scanner and one or more illumination sources such as targeted light emitting diodes, facilitating omni-directional scanning a in lowlight conditions. In other embodiments, imager 338 may comprise other devices configured to sense or capture the visible image such as other forms of a camera or other two dimensional (2D) charge coupled devices (CCD) and the like. In yet other embodiments, imager 338 may utilize ultraviolet or infrared light to scan or sense an image on surface. In one embodiment, imager 338 may be configured to read a code such as a Maxi code, barcode, Universal Product Code (UPC) and the like.

Communication interface 340 is configured to communicate with external electronic devices such as external data sources (not shown). Communication interface 340 is configured to transmit data as well as to receive data. In one embodiment, communication interface 340 is configured to communicate wirelessly with external electronic devices. For example, in the particular embodiment illustrated, communication interface 340 is configured to communicate with radio waves and comprises wireless IEEE 802.11g module. In such an embodiment, the metallic housing of body 336 enhances cooling and dissipation of the heat generated by communication interface 340. In other embodiments, communication interface 340 may communicate with ultraviolet or infrared light. In still other embodiments, communication interface 340 may be a wired connection where communication occurs through electrical or optical cables. In other embodiments where a data source is incorporated into capture and print unit 330 as part of controller 354 and its memory, communication interface 340 may be omitted.

Print device 342 comprises a device configured to eject or deposit printing material upon a surface, such as surface 100 (shown in FIG. 3). According to one embodiment, print device 342 is configured to deposit a fluid printing material or solution. According to one embodiment, print device 342 comprises a thermal resistive drop-on-demand ink jet print head. According one embodiment, print device 342 comprises a removable ink jet cartridge.

Indicator 344 comprises one or more devices configured to provide an indication of when print device 342 is ready for printing. Indicator 344 further provides an indication of when image capture has been initiated and when capture and print unit 330 is in sufficiently close proximity to a surface for printing upon the surface. In the embodiment illustrated, indicator 344 comprises a plurality of light emitting diodes configured to emit different colors of light or configured to emit light which is filtered by different colored light filters, wherein the different colors of light indicate or communicate different information to a person using unit 330. In other embodiments, indicator 344 may have other configurations. For example, indicator 344 may additionally or alternatively be configured to provide distinct audible signals or sounds based on the state of capture and print unit 330. In yet other embodiments, indicator 344 may be omitted.

User interface 345 comprises an interface by which a person may enter commands instructing capture and print unit 330 to initiate printing with print device 342. For example, upon receiving an indication that print device 342 is at an appropriate temperature for printing from indicator 344, a person may actuate or otherwise enter a command via interface 345 to begin printing. In the example embodiment illustrated, user interface 345 comprises a pair of buttons, When depressed manually actuates switches to create electoral signals which are transmitted to controller 354. In other embodiments, interface 345 may comprise a touch pad, lever, switch, slide or other device by which a person may use his or her hands or fingers to enter a command. In another embodiment, user interface 345 may comprise a microphone with associated voice or speech recognition software. In yet other embodiments, user interface 345 may be omitted where other mechanisms are employed for initiating printing. For example, in one embodiment, printing may be initiated in response to signals received from print sensor 346.

Print sensor 346 comprises a sensing device configured to detect relative movement of capture and print unit 330, and in particular, print device 342, relative to a surface being printed upon. Signals from print sensor 346 indicate the relative speed at which print device 342 is moving relative to the surface being printed upon or vice versa. Signals from print sensor 346 are used by controller 354 to control the rate at which printing material is discharged from print device 342 and which particular nozzles are being discharged to form an image. In the particular embodiment illustrated, print sensor 346 is further configured to indicate contact or sufficiently close proximity of print device 342 to the surface and the initiation of printing. In other embodiments, the initiation a printing may alternatively begin in response to actuation of a separate trigger such as to the use of interface 345.

In the example embodiment illustrated, print sensor 346 comprises an encoder wheel 361 and associated encoder 363 wherein the encoder wheel 361 is rotated a long the surface being printed upon. In other embodiments, print sensor 346 may comprise a navigational sensor or other sensing device.

Sensor 348 comprises a device configured to sense an image separation distance between the surface having an image and sensor 348 or imager 338. Sensor 348 generates and transmits signals to controller 354, wherein controller 354 determines an image separation distance using such signals and generates a warming signal initiating the capture of an image by imager 338 and readying of print device 342.

According to one embodiment, sensor 348 detects the image separation distance without contacting the surface being printed upon. In one embodiment, sensor 348 comprises an ultrasonic circuit or sensor. As shown by FIG. 4, in the embodiment illustrated, sensor 348 comprises a pair of ultrasonic ranging sensors located on either side of imager 338 for enhanced detection of image separation distance separating the surface to be scanned for an image and imager 338. In other embodiments, sensor 348 may comprise other ultrasonic sensors or may comprise other non-contact type sensors such as infrared sensors. In still other embodiments, sensor 348 may comprise a sensor which contacts the surface being scanned or read when determining the image separation distance.

Manual trigger 350 comprises a user or human interface configured to permit a user or person to initiate the generation of a trigger signal. In one embodiment, manual trigger 350 may be configured to generate a trigger signal in response to contact with or force exerted by a person's hand or one or more fingers. For example, manual trigger 350 may comprise a button, slide, trigger structure or other structure.

Controller 354 comprises one or more processing units physically associated with capture and print unit 330 and configured to generate control signals directing operation of imager 338 and print device 342. In the particular example illustrated, controller 354 receives signals via encoder wheel 361 during manual movement of unit 330 across the surface being printed upon. Based upon the relative movement, controller 354 generates control signals controlling what particular nozzles of print device 342 are fired and the rate at which they are fired to eject ink or other printing material through opening 52 and onto the surface opposite to print device 342.

Figure 6:
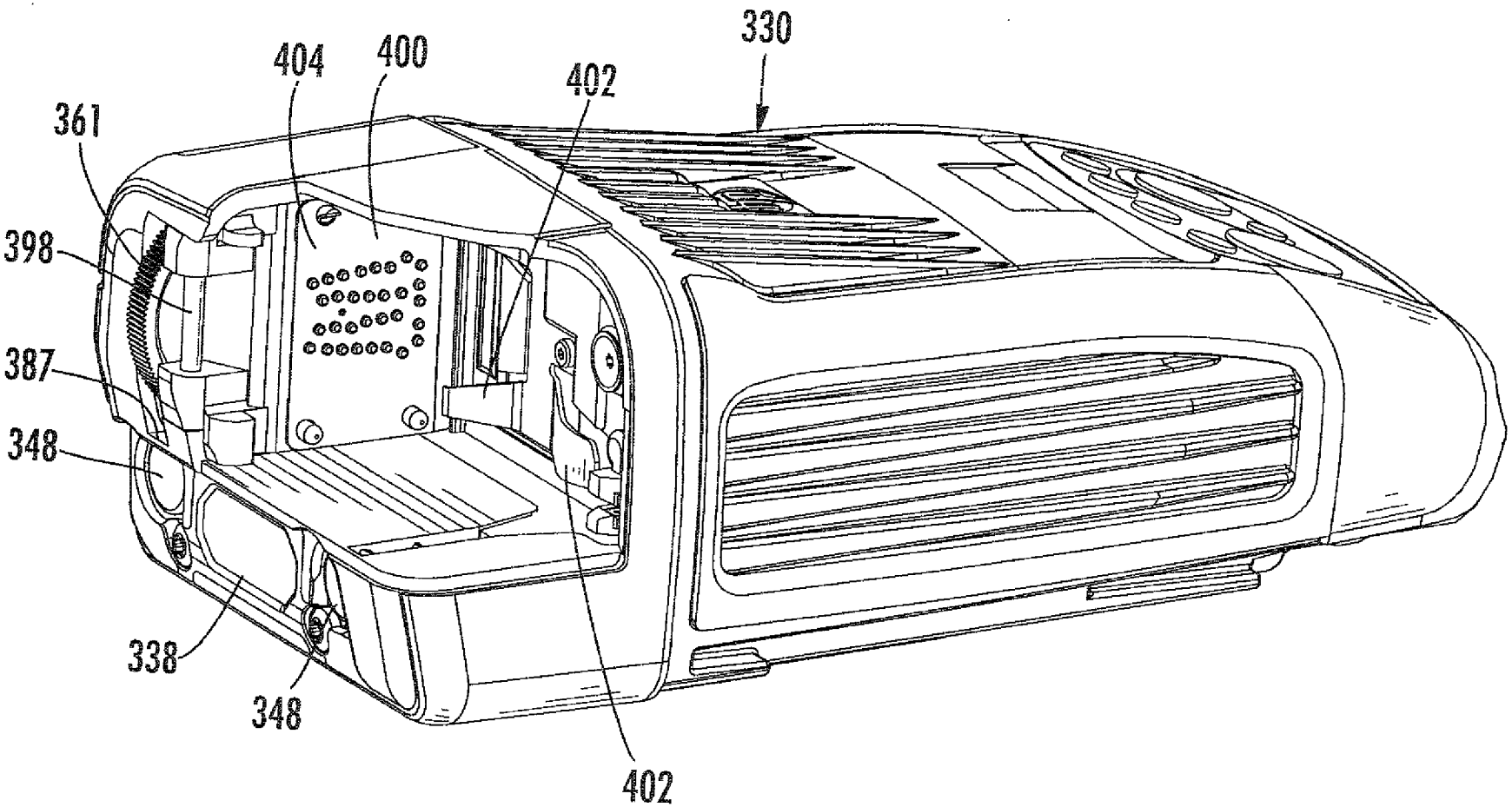
FIG. 6 is a top perspective view of the print unit of FIG. 5 without the media guide attachment and omitting a print device according to an example embodiment.
Figure 7:
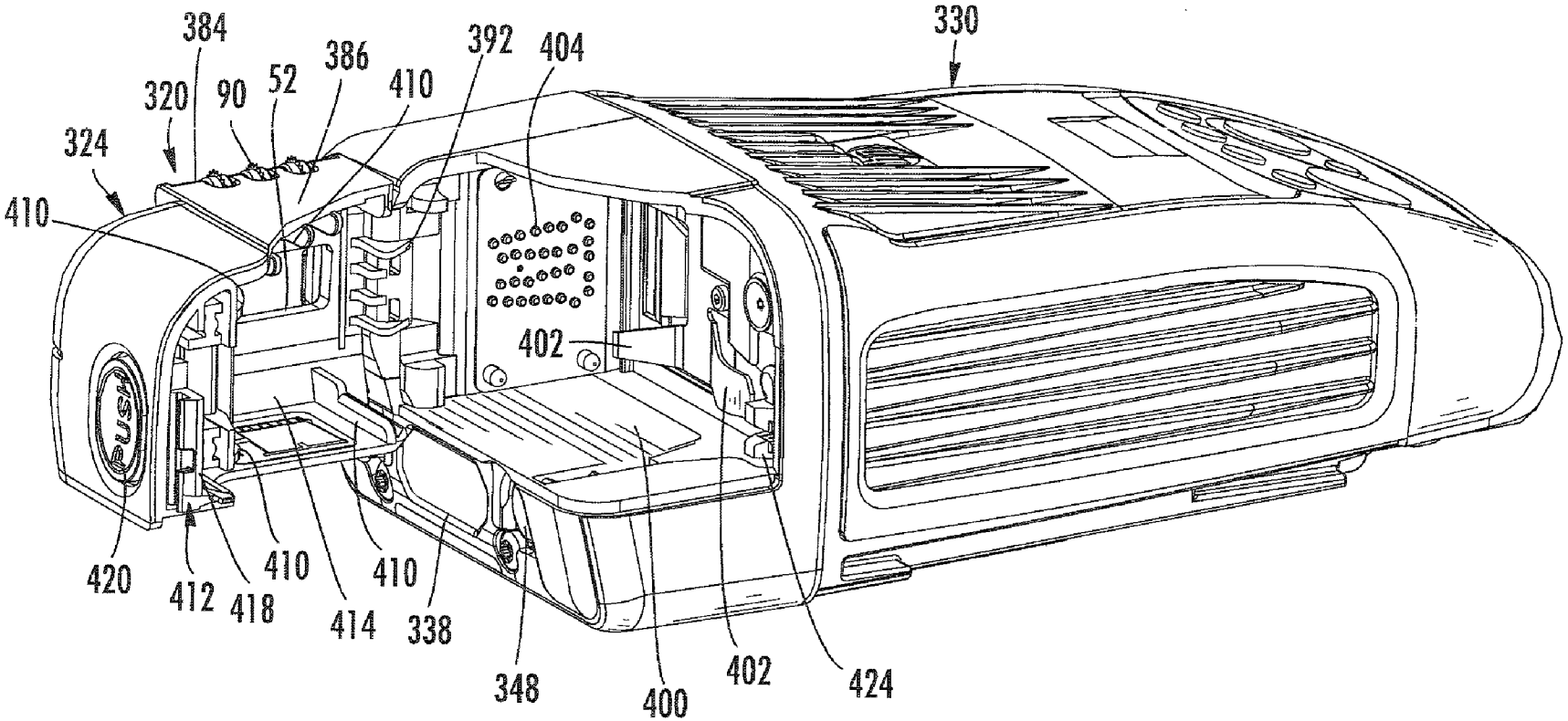
FIG. 7 is a top perspective view of the media guide attachment mounted to the print unit and in an open position with the print device removed according to an example embodiment.
Figure 8:
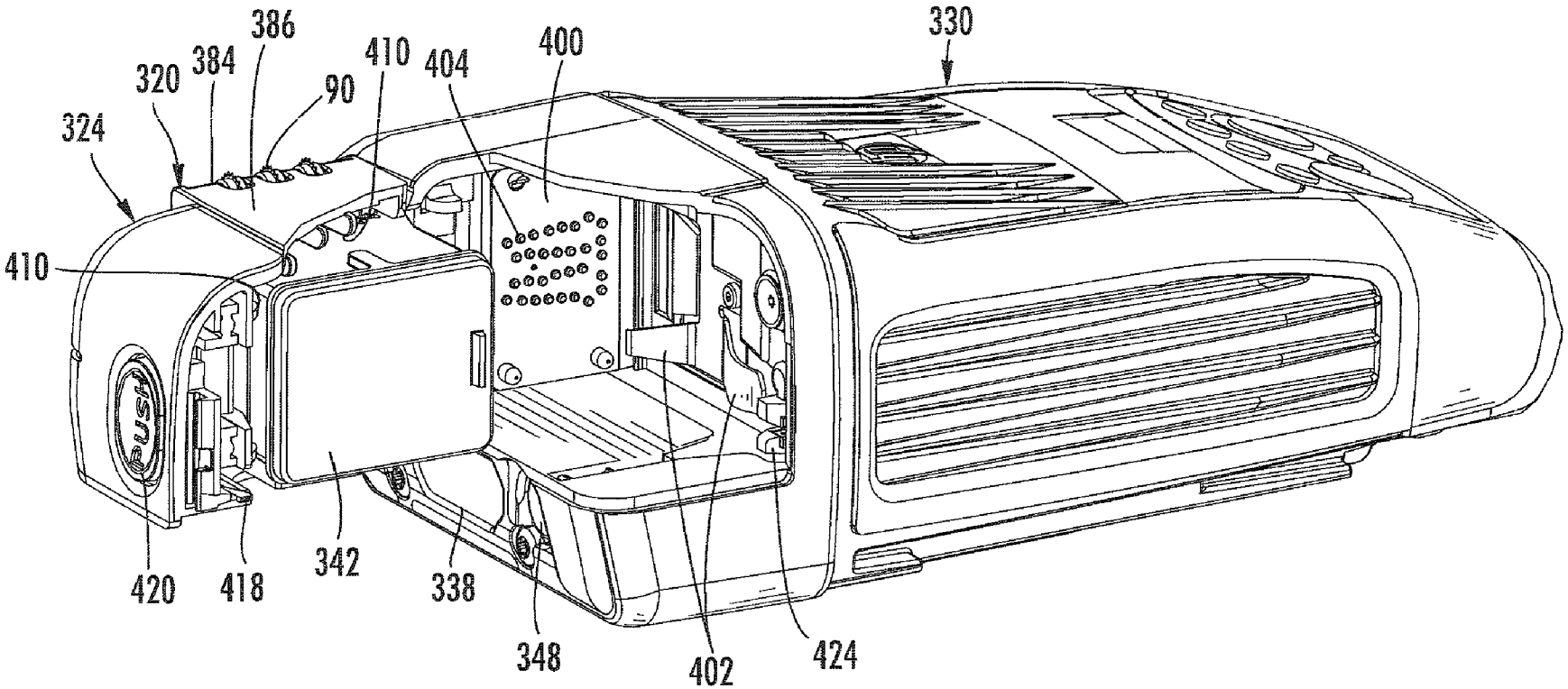
FIG. 8 is a top perspective view of the media guide attachment mounted to the print unit and in an open position with the print device carried by the media guide attachment according to an example embodiment.

FIGS. 6-8 illustrate mounting of attachment 320 on unit 330 in more detail. FIG. 6 illustrates unit 330 with attachment 320 and print device 342 removed. FIG. 7 illustrates attachment 320 mounted to unit 330 and in an open state. Lastly, FIG. 8 illustrates print device 342 mounted to attachment 320 while attachment 320 is in the open state. As shown by FIG. 6, in the example illustrated, unit 330 includes a cavity 400 configured to receive print device 342. In the example illustrated, print device 342 comprises a drop-on-demand inkjet pen or cartridge. Unit 330 further includes springs 402 for biasing print device 342 and a communication interface 404 comprising electrical contact or pins for communicating and controlling printing to by print device 342.

FIG. 7 illustrates attachment 320 pivotably mounted to unit 330. In particular, book 392 is positioned about and retained upon shaft 398 (shown in FIG. 6) facilitating pivotable movement of attachment 320 about the axis of shaft 398. As further shown by FIG. 7, attachment 320 further includes cartridge locating surfaces 410 and retainer 412. Cartridge locating surfaces 410 comprise surfaces or datums in a cavity 414 within support 324 which locate and assist in supporting and retaining print device 342 when attachment 320 is in the closed state (shown in FIG. 5) and when attachment 320 is in the open state shown. As a result, print device 342 may be mounted to attachment 320 independent of unit 330.

Retainer 412 comprises a mechanism configured to retain attachment 320 in the closed position shown in FIG. 5). An example illustrated, retainer number 412 includes a catch 418 and a lever or pushbutton 420. Catch 418 is configured to receiving capture a corresponding rim or catch 424 of unit 330. The present of button number 420 moves catch 418 against the bias provided by a spring (not shown) to disengage catch 418 from catch 424 and permit attachment 323 pivoted to the open position shown.

FIG. 8 illustrates insertion of print device 342 into cavity 414 of attachment 320. Once print device 0342 is retained by cartridge locating services 410 within cavity 414, attachment 320 may be pivoted about shaft 398 (shown in FIG. 6) to the closed position shown in FIG. 5. When attachment 320 is in the closed position or state, springs 402 bear against print device 342 to urge the nozzles (not shown) of print device 342 against attachment 342 aligned with opening 52. As such, print device 342 is loaded and ready for use.

Although FIGS. 6-8 illustrate attachment 320 as being releasably attachable and pivotable relative to unit 330, in other moderates, attachment 320 may alternatively be attached to and disconnected from unit 330 while not pivoting. In such an embodiment, print device directory 42 may be mounted to attachment 320 prior to attachment of the attachment 320 to unit 330. In yet other embodiments, attachment 320 may not be configured to retain and hold the device 342. In such an embodiment, print device 342 and amount within cavity 400 of unit 330, wherein attachment root 320 is mounted over print device 342.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a print device;

a housing having an external face with an opening adjacent the print device, the housing being configured to be manually moved in a longitudinal downstream direction along a surface as the print device prints upon the surface; and at least one media guide along the face configured to control positioning of the surface relative to the opening and the print device as the face is manually moved relative to the surface during printing, wherein the at least one media guide comprises first and second ribs upstream of the print device along the face, the first and second ribs diverging from each other as they approach the print device.

2. The apparatus of claim 1, wherein the at least one media guide includes rotatable idling control wheels downstream of the opening.

3. The apparatus of claim 2, wherein the control wheels each include a plurality of circumferentially spaced projections.

4. The apparatus of claim 1, wherein the at least one media guide comprises a pair of ribs along the external face on opposite lateral sides of the print device.

5. The apparatus of claim 1, wherein the at least one media guide includes a third rib along the face of stream of the print device, the third rib extending laterally across the print device.

6. The apparatus of claim 1, wherein the at least one media guide includes a pair of ribs along the surface on lateral sides of the print device downstream of the print device.

7. The apparatus of claim 1 further comprising a recessed cavity downstream of the print device.

8. The apparatus of claim 1, wherein the housing comprises:

a main body supporting the print device; and a media guide attachment releasably connected to the body and including the at least one media guide.

9. The apparatus of claim 8, wherein the first and second ribs are integrally formed as a single unitary body with the media guide attachment.

10. The apparatus of claim 9, wherein the at least one media guide further comprises a pair of ribs along the external face on opposite lateral sides of the print device and integrally formed as a single unitary body with the media guide attachment.

11. The apparatus of claim 10, wherein the at least one media guide includes idling control wheels downstream of the opening and rotationally supported by the media guide attachment.

12. The apparatus of claim 11 further comprising a recessed cavity at least partially formed by the media guide attachment downstream of the print device and upstream the control wheels.

13. The apparatus of claim 9, wherein the at least one media guide includes idling control wheels downstream of the opening and rotatably supported by the media guide attachment.

14. The apparatus of claim 8 further comprising an encoder wheel configured to sense movement of the print device along the surface, wherein the media guide attachment includes a first opening and includes a second opening through which the encoder wheel projects.

15. The apparatus of claim 1 further comprising an encoder wheel configured to sense movement of the print device along the surface.

16. An apparatus comprising:

a media guide attachment configured to be releasably mounted to a hand held unit including a print device, the media guide attachment including an opening through which the print device prints onto a surface and at least one media guide configured to control positioning of the surface being printed upon relative to the print device as a the hand held unit is moved manually relative to the surface during printing, wherein the at least one media guide comprises first and second ribs upstream of the print device along the face, the first and second ribs diverging from each other as they approach the print device and integrally formed as a single unitary body with the media guide attachment.

17. The apparatus of claim 16, wherein the at least one media guide includes idling control wheels downstream of the opening and rotatably supported by the media guide attachment.

18. A method comprising:

manually moving a unit including a print device into proximity with a compressible surface, wherein the unit extends only on a single side of the surface; and guiding relative movement of the print device and the surface with one or more media guides along an external face of the unit and proximate the print device, wherein the one or more media guides comprise first and second ribs upstream of the print device along the face, the first and second ribs diverging from each other as they approach the print device.

* * * * *

UNITED STATES PATENT AND TRADEMARK OFFICE

CERTIFICATE OF CORRECTION

PATENT NO. : 7,811,013 B2
APPLICATION NO. : 11/830805
DATED : October 12, 2010
INVENTOR(S) : Jimmy Perez et al.

It is certified that error appears in the above-identified patent and that said Letters Patent is hereby corrected as shown below:

In column 12, line 20, in Claim 16, delete “a the” and insert -- the --, therefor.

Signed and Sealed this
Twelfth Day of April, 2011

David J. Kappos

David J. Kappos
*Director of the United States Patent and Trademark Office*